US005169544A

United States Patent [19]

Stanfill et al.

[11] Patent Number: 5,169,544

[45] Date of Patent: Dec. 8, 1992

[54] BUCK FOR USE IN CONSTRUCTION

[76] Inventors: Michael E. Stanfill, 5069 Boabab Dr., Holladay, Utah 84117; Byron G. Bueter, 4731 W. 3145 South, Salt Lake City, Utah 84120

[21] Appl. No.: 401,034

[22] Filed: Aug. 31, 1989

[51] Int. Cl.[5] ..... E04G 15/02

[52] U.S. Cl. ..... 249/22; 52/215; 249/35; 249/36; 249/39; 249/97

[58] Field of Search ..... 249/22, 39, 35, 36, 249/37, 43, 183, 97; 52/204, 215, 127.1

[56] References Cited

U.S. PATENT DOCUMENTS

| | | | |
|---|---|---|---|
| 1,051,568 | 1/1913 | Emtman | 249/39 |
| 2,683,913 | 7/1954 | Honnigford | 25/131 |
| 2,787,820 | 4/1957 | Shields et al. | 25/131 |
| 2,901,810 | 9/1959 | Richards | 25/131 |
| 3,439,894 | 4/1969 | Haider | 249/39 |
| 3,517,906 | 6/1970 | Blonde | 249/39 |
| 3,994,470 | 11/1976 | Nakada | 249/93 |
| 4,047,691 | 9/1977 | Wolf | 249/39 |
| 4,138,084 | 2/1979 | Reid | 249/39 |
| 4,159,098 | 6/1979 | Wong | 249/61 |
| 4,159,099 | 6/1979 | Maguire | 249/39 |
| 4,430,831 | 2/1984 | Kemp | 249/39 |
| 4,625,940 | 12/1986 | Barton | 249/39 |
| 4,666,388 | 5/1987 | Kovasna et al. | 425/62 |
| 4,690,368 | 9/1987 | Heiman | 249/39 |

FOREIGN PATENT DOCUMENTS

| | | | |
|---|---|---|---|
| 2327225 | 12/1974 | Fed. Rep. of Germany | 249/39 |
| 2579251 | 9/1986 | France | 249/39 |
| 977650 | 11/1982 | U.S.S.R. | 249/39 |

*Primary Examiner*—Jay H. Woo
*Assistant Examiner*—Khanh P. Nguyen

[57] ABSTRACT

A plastic buck which is used to form an opening in a wall to be constructed of concrete or other flowable building material. The buck includes flanges on each side which contain mounting holes used to mount the buck to a wall form. Additionally, the flanges include holes for mounting fasteners onto the window buck thereby enabling the fastener to be cast within the concrete wall. The buck includes bracing members configured within the buck to prevent the forces of the building material on the window buck from causing unacceptable deformations in the buck as the wall is poured. Handles are also attached to the window buck to facilitate installation and removal of the buck. A plurality of knock blocks are located on the buck such that one may apply impact forces to the buck to remove the buck from the concrete wall after the concrete has set. Since the buck is constructed of plastic or other nonporous material, removal of the buck from the poured wall is facilitated.

11 Claims, 2 Drawing Sheets

BUCK FOR USE IN CONSTRUCTION

BACKGROUND

1. Field of the Invention

The present invention relates to methods and apparatus for forming an opening in a wall constructed of concrete or other similar flowable material. More particularly, the present invention relates to a plastic window buck and methods of using the buck in forming a window opening in a concrete wall.

2. The Background of the Invention

In the construction of many buildings, the walls of the buildings are poured of concrete or other similar flowable construction materials. When it is desired that those concrete walls contain windows or other openings, a frame, or "window buck," is mounted within the concrete form for the walls so that a window opening is left in the wall after the concrete wall has been poured.

A conventional method of forming the window opening in a concrete wall is to employ a metal frame, usually made of galvanized steel, which is mounted within the form of the wall. After the wall has been poured, this metal frame may be left in the wall to act as a frame within which the window may be mounted.

A significant disadvantage to using such a permanent window buck is the expense associated with its use. The materials cost for the project is increased significantly because a separate window buck must be purchased for each window to be included in the project.

Another disadvantage associated with the use of such window bucks is that they will often buckle or otherwise fail under the pressure of the wet concrete. To prevent the window buck from failing before the concrete has set, it is often necessary to structurally reinforce the window buck prior to pouring the concrete for the wall. The window buck is typically reinforced by building a web out of lumber which is placed within the window buck. It will be appreciated, however, that the time and expense associated with reinforcing the window buck with a wood bracing structure may add significantly to the cost of the project.

One proposed solution to the problems outlined above is the use of a reusable window buck. Such a window buck is typically constructed of metal and is designed to be removed from the concrete wall after the concrete has set, thereby enabling the buck to be used repeatedly. Thus, the expense of the window buck may be spread over several projects.

Because the window buck must be strong and durable, most reusable window bucks are constructed of metal and are reinforced throughout to withstand the pressures imposed by the concrete as the wall is poured. Because of the amount of metal employed in these window bucks, they are typically too heavy for one laborer to effectively handle alone.

The extreme weight of the window buck requires that at least two people work to install and remove them. Alternatively, some crews will employ a hoist or other piece of equipment to assist in the installation and removal of such window bucks. Again, the extra labor and machinery which must be used when working with such window bucks increases the costs associated with their use.

A significant problem associated with the use of metal and wood window bucks which are designed to be reusable is the difficulty of removing the bucks after the concrete has set. Because the surfaces of these window bucks are porous, the concrete adheres significantly to the window buck. When attempting to remove the buck from the concrete wall, it is often necessary to spend a great deal of time attempting to break away the seal which has formed between the window buck and the concrete wall. Occasionally, the window buck will effectively be destroyed because of difficulties in removing the buck from the wall.

In an attempt to facilitate the removal of the window buck, some window bucks have been proposed which can be "collapsed" within the window opening after the concrete has set. Such collapsible window bucks are usually more expensive than their noncollapsible counterparts because of the inclusion of the collapsible mechanism. Additionally, they tend to be heavier, thereby adding to their awkwardness during installation and removal.

An almost universal problem from which virtually all types of window bucks suffer is that they are frequently adversely affected by the constant and repeated exposure to the water contained in the concrete. Wood window bucks begin to rot after repeated uses and metal window bucks start to rust. Over time, the rust or rot in the window buck can result in the ultimate failure of the buck, requiring its replacement.

It will be appreciated, therefore, that what is needed in the art is a window buck and methods for use for providing a window opening in a wall to be poured of concrete or other similar flowable material which is reusable such that there is not a high materials cost associated with each window and allowing the initial expense of the window buck to be spread over several projects.

It would also be an advancement in the art if such a window buck could be provided which is simple to install and remove and which does not involve numerous complex parts.

It would be a further advancement in the art of such a window buck would be light weight such that it could be installed and removed by one person.

It would be an enhancement of the art if such a window buck could be provided which had only minimal adherence to concrete, thereby facilitating its removal after the concrete around it sets.

It would be yet a further enhancement in the art if such a window buck would not be adversely affected by constant and repeated exposure to water.

The foregoing, and other features and objects of the present invention, are realized in the window buck which is disclosed and claimed herein.

BRIEF SUMMARY AND OBJECTS OF THE INVENTION

The present invention includes novel methods and apparatus for forming an opening in a wall constructed of concrete or other similar flowable material. The invention includes a buck made of plastic which is configured to be mounted on conventional concrete forms used in forming up walls. The plastic buck includes braces which prevent the buck from deforming beyond acceptable limits when concrete is poured into the form, around the buck.

The buck is tapered outwardly such that the perimeter of the buck gradually increases from the inside to the outside of the wall. This taper facilitates removal of the buck when the wall has been poured and the concrete has set. By providing the buck with a taper, once the buck is moved a slight distance with respect to the concrete, a slight gap is created between the buck and the concrete. As removal of the buck continues, the distance between the buck and the window continues to increase until the buck may be easily withdrawn from the window. As used herein, "window" refers to the combination of a glass or plastic pane and any frame, whether wood, metal or otherwise, which may be used with the pane.

To further facilitate removal of the buck, a series of "knock blocks" are provided at various locations on the buck. These knock blocks provide locations along the buck which may be hit with a hammer when removing the buck from the wall.

Because of the plastic construction of the buck, the buck is light weight and may be easily lifted by one person. Thus, to render the buck more manageable, the buck also includes handles which may be attached to the braces on the buck.

The buck is provided with flanges on opposite sides which are used in installing the buck. Each of the flanges includes holes through which the buck may be nailed to a conventional wood form used in forming up the wall. Thus, the buck may be nailed directly to one side of the wall form to position the buck at the appropriate location within the wall. After the buck has been positioned on one side of the wall form, the other side of the wall form may be installed in place against the opposite side of the buck.

The flanges also include holes for use in mounting threaded fasteners within the wall. The threaded fasteners consist of a threaded female member which is placed on the side of the flange where the concrete is to be poured. The threaded female member is attached to the flange by a bolt which is inserted through the flange and threaded into the threaded female member. After the concrete has set, the bolt may be removed by unscrewing it and leaving the threaded fastener in place. Thus, the threaded fastener provides a threaded hole in the concrete wall which may be used in mounting a window to the wall.

The present invention is constructed of plastic or other similar light weight nonporous materials. The plastic construction of the buck of the present invention enables the buck to be easily removed from the wall after the concrete has set. Because plastic is not as porous as other materials typically used in the construction of window bucks, there is less adherence of the concrete to the buck.

The plastic construction of the buck additionally provides a buck which is not adversely affected by repeated exposure to water. Because water is a primary ingredient in wet concrete, window bucks are exposed to water with each use. The plastic construction of the buck, thus, provides a buck which does not deteriorate with repeated exposure to water.

It is, therefore, a primary object of the present invention to provide a buck and methods for use for framing an opening in a wall to be poured of concrete or other similar material which can be reused.

It is also an object of the present invention to provide such a buck which is simple to install and remove.

It is an additional object of the present invention to provide such a buck which is light weight, thereby enabling the window buck to be installed and removed by only one person.

It is a further object of the present invention to provide such a buck which has only minimal adherence to concrete, thereby enabling the seal formed between the window buck and the concrete to be easily broken upon removal of the buck.

Another object of the present invention is to provide such a buck which is not adversely affected by repeated exposure to water, such as the water found in concrete.

Other objects and advantages of the present invention will become apparent upon reading the following detailed description and appended claims, and upon reference to the accompanying drawings.

DETAILED DESCRIPTION OF THE PREFERRED EMBODIMENTS

Reference is now made to the drawings wherein like parts are designated with like numerals throughout. The present invention is directed to methods and apparatus for forming an opening for a window to be located within a wall constructed of concrete or other similar flowable building material. One embodiment of a buck according to the present invention is illustrated in FIG. 1 and generally designated at 10.

Figure 1:
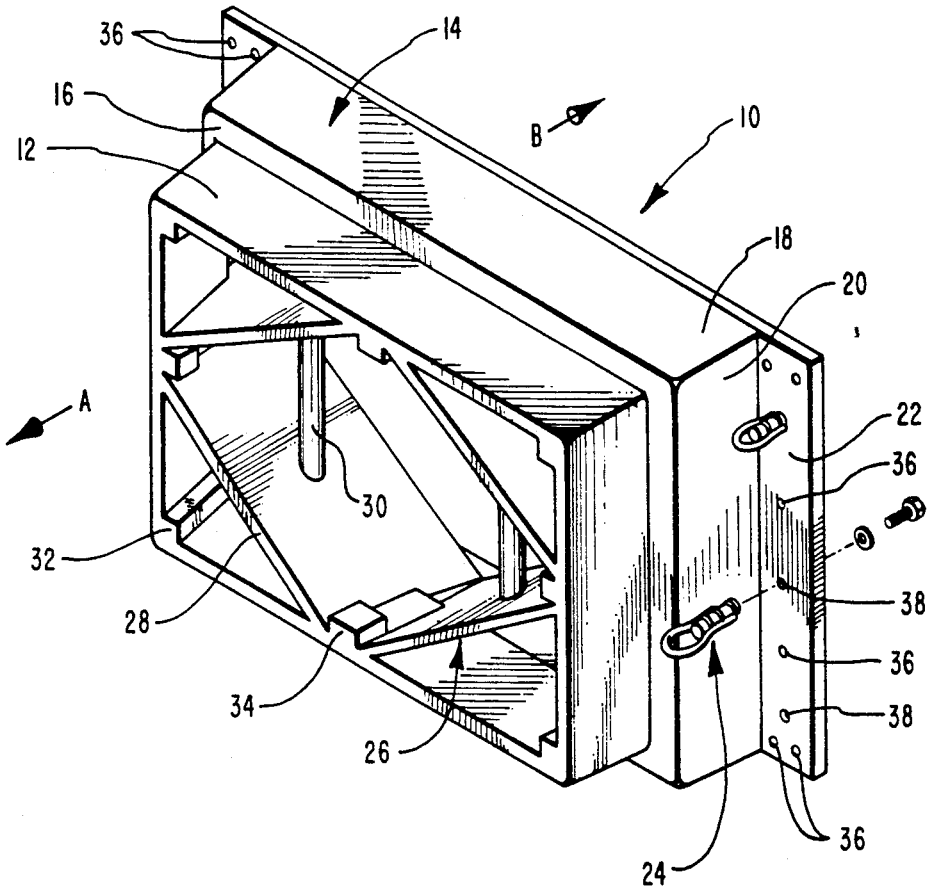
FIG. 1 is a perspective view of an embodiment of the buck of the present invention.

As illustrated in FIG. 1, the window buck 10 includes two tiers, an inner tier 12 and an outer tier 14. Inner tier 12 is connected to outer tier 14 by means of a lip 16. It will be appreciated by one skilled in the art of construction that the advantages of the present invention may be obtained in a window buck which includes only one tier and no lip. However, because many windows are designed to be mounted within a window frame having a lip, the present invention is illustrated as designed to provide such a lip.

In a typical two-tier application, the inner tier 12 has a smaller perimeter than the outer tier 14. Thus, the inner tier 12 is disposed on the side of the window buck 10 which is towards the inside of the house or building containing the window. The direction of the interior of the building is illustrated as the direction of Arrow A. Outer tier 14 is disposed on the side of the window buck which is directed towards the outside of the window, or in the direction of Arrow B.

The "width" of the window buck (in the direction of Arrows A and B) is approximately the width of the wall within which the window buck is to be used. As will be explained in greater detail below, the window buck fits substantially flush against each side of the wall forms used in pouring the wall. Thus, window bucks of a variety of widths may be employed according to the width of the wall in which a window opening is desired.

Each outer tier comprises two horizontal panels 18 and two vertical panels 20. Attached to each of the vertical panels 20 is a flange 22. The particular function of flanges 22 will be more particularly explained in conjunction with FIG. 2. It should be appreciated, however, that flanges 22 may also be configured in connection with horizontal panels 18. It is presently preferred, however, that flanges 22 be attached to vertical panels 20 of the outer tier 14.

According to the present invention, a fastening means 24 is provided which provides means for fastening a window to the wall which is poured around the window buck.

Still referring to Figure the window buck of the present invention also comprises bracing means 26. In a presently preferred embodiment of the invention, bracing means 26 comprises four bracing members 28. Each bracing member 28 is diagonally disposed within the window buck; that is, each bracing member 28 extends from a point along one of the sides to a point along an adjacent side. In a preferred embodiment, each bracing member 28 is connected at approximately the middle of each side of the window buck and extends to approximately the middle of an adjacent side, as illustrated best in FIGS. 1 and 2.

It is presently preferred that each bracing member be approximately as deep as the window buck itself. Thus, each bracing member 28 extends approximately from the inside (Arrow A) of the inner tier 12 to the outside (Arrow B) of outer tier 14. It has been found that this particular configuration provides sufficient bracing to prevent unacceptable deformation of the window buck as wet concrete or other material is poured around the window buck.

The bracing means 26 may also include a variety of other bracing configurations. By way of example, but not by limitation, bracing means 26 may include several separate bracing members extending along the same general directions as bracing members 28 in FIGS. 1 and 2. Additionally, rather than being mounted at approximately the middle of the sides of the window bucks, bracing means 26 may employ bracing members mounted at various locations along the sides of the window buck. The bracing means 26 may also include bracing members mounted in vertical and horizontal directions within the window buck.

Thus, one skilled in the art will readily appreciate that a variety of configurations of bracing members will provide satisfactory bracing of the window buck to prevent unacceptable deformation of the window buck during use.

In a presently preferred embodiment of the invention, handles 30 are attached to the bracing members 28. The handles are primarily for ease of handling the window buck, although, in some embodiments of the window buck, they may provide some bracing function.

A number of knock blocks are also included on the window buck to facilitate removal of the window buck from the concrete wall after the concrete has set. As illustrated in FIG. 1, a corner knock block 32 is provided in each corner of the window buck. Additionally, four sidewall knock blocks 34 are also provided along each side of the window buck. Knock blocks may also be provided in a variety of other locations along the window buck.

The window buck of the present invention may be made of a variety of light weight nonporous materials, such as plastics. As used herein, the term "plastics" includes polymeric and resinous materials, including fiber reinforced composites. Thermoplastic or thermosetting polymers are found to be acceptable and to be within the scope of the present invention. It has been found that thermoplastic polymers such as polypropylene and polyethylene are particularly suited for use in the manufacture of the window buck of the present invention. It is presently preferred that polypropylene be employed in the manufacture of window bucks according to the present invention.

A variety of methods of manufacture may be utilized in manufacturing window bucks according to the present invention. A presently preferred method, and one which readily lends itself to mass production, is to produce a mold and form the window buck according to an injection molding process. Alternatively, the window buck may be formed of component parts using a plastic welder. Other methods known in the art of plastic manufacture may also be utilized to produce the buck of the present invention.

Although the window buck illustrated in FIG. 1 is generally rectangular in shape, it will be appreciated that such a window buck could be provided for a variety of shapes of windows and other types of openings. For example, round, oval, or semi-circular window bucks could be provided according to the teachings of the present invention to accommodate windows having those shapes.

Figure 2:
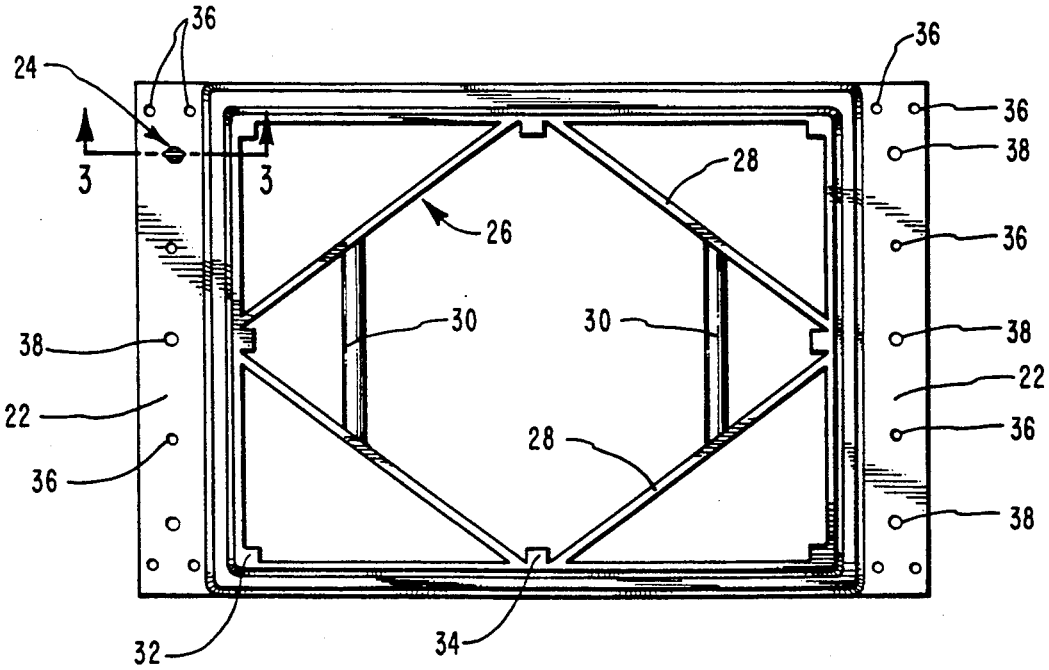
FIG. 2 is a front of the buck of FIG. 1.

Referring now to FIG. 2, the hole patterns in flanges 22 are more particularly illustrated. Each flange 22 contains a series of mounting holes 36. As will be explained in greater detail below, mounting holes 36 are utilized in mounting the window buck within the wall forms. Although a variety of mounting hole patterns may be employed, it has been found that the pattern illustrated in FIG. 2 is effective.

Also included in each flange 22 are a series of fastener holes 38. Fastener holes 38 provide means through which threaded fasteners may be mounted within the wall, as best viewed in FIG. 3. When the window buck is used to form a window opening in a concrete wall, the flanges 22 will leave a correspondingly shaped indentation in the wall.

In a preferred embodiment of the invention, the flanges 22 are configured to match the flanges on areawalls. Thus, after the concrete wall has been poured and has set, the areawalls may be attached to the wall by means of bolts threaded into the threaded fasteners. Because the flanges on the areawalls will fit within the recesses in the wall caused by flanges 22, the areawall flanges may be covered with plaster or brick after the areawall has been installed. Accordingly, the aesthetics of the areawall may be improved.

Figure 3:
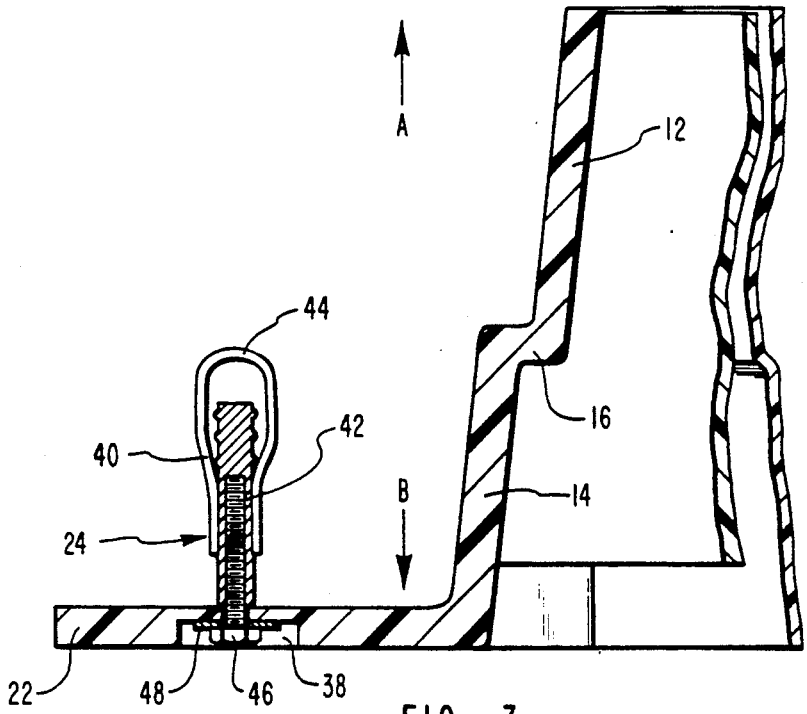
FIG. 3 is a cross-sectional view taken along line 3—3 of FIG. 2.

In FIG. 3, fastening means 24 comprises a threaded fastener 40. Threaded fastener 40 includes a threaded female member 42 which fits against the flange 22. Attached to threaded female member 42 is a reinforcing loop 44. Threaded into threaded female member 42 is a bolt 46 which is typically used in combination with a washer 48.

Figure 4:
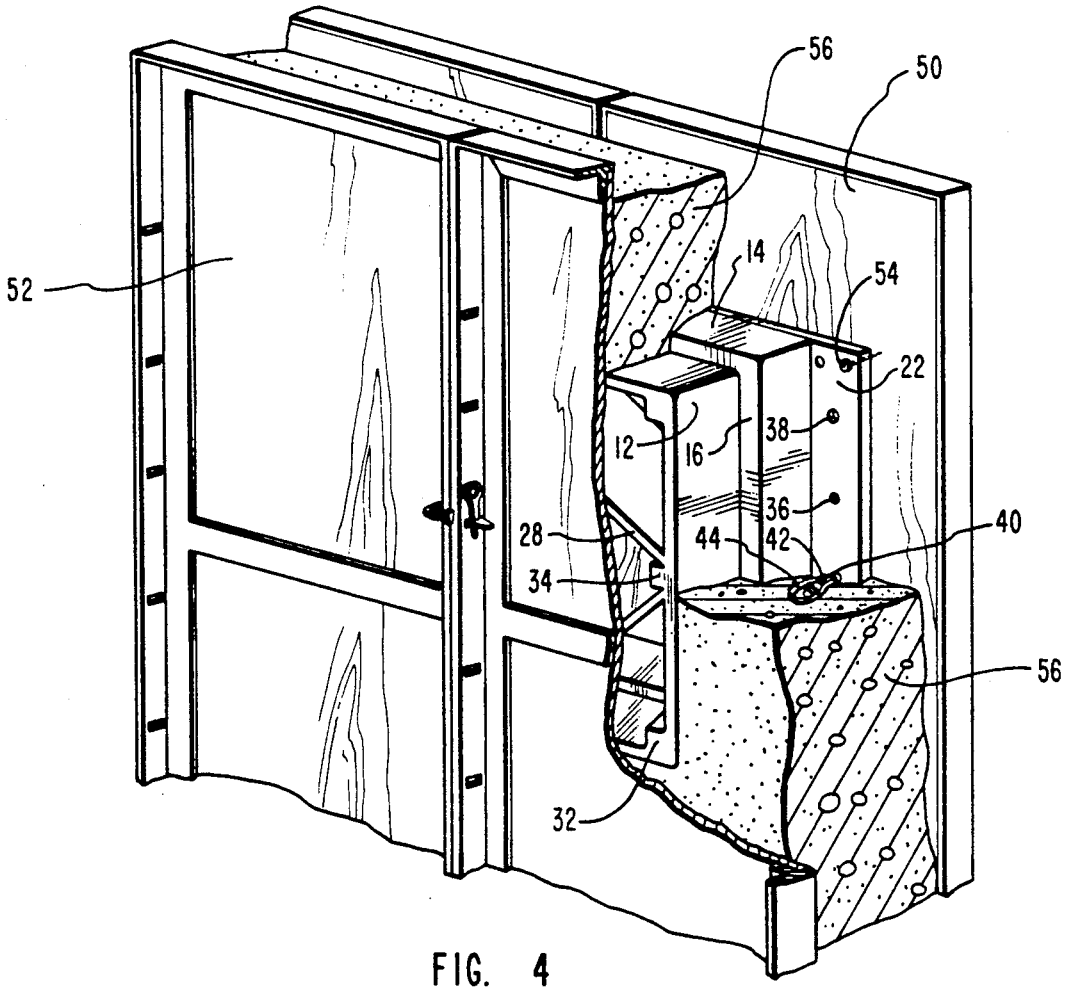
FIG. 4 is a perspective view of an embodiment of the buck of the present invention shown installed inside a wall form with concrete poured in the form, with portions of the figure cut away to more particularly illustrate the features of the buck.

As can be viewed best in FIGS. 3 and 4, the threaded fastener is attached to the flange 22 by inserting a bolt 46 through the fastener hole 38 and threading it into the threaded female member 42 of the threaded fastener 40. When the bolt 46 is tightened, the threaded fastener 40 will extend substantially perpendicular to the plane of the flange 22.

As seen in FIG. 3, the mounting hole 38 includes a recessed portion which enables the head of bolt 46 to rest beneath the outside surface of the flange 22. This allows the flange to rest flush against the outer wall form when it is installed against the wall form, as will be explained in further detail below.

When concrete is poured to form a wall around the window buck, the threaded fastener 40 is firmly mounted within the concrete. The reinforcing loop 44 acts to ensure that the threaded fastener is rigidly mounted within the resulting concrete wall.

After the concrete has set, the bolt 46 and washer 48 may be removed, thereby allowing the window buck to also be removed. Following removal of the window buck, the threaded fastener 40 remains mounted within the concrete wall. Thus, when installing an areawall around the window opening which is created, the areawall may be mounted to the concrete wall by threading a bolt through the flange on the areawall and into the threaded fastener.

It will be appreciated that threaded fasteners may also be used to assist in mounting other types of window dressings, such as shutters, or other articles to the concrete wall. Thus, flange 22 may be configured with any of a variety of fastener hole patterns to enable threaded fasteners to be mounted within the wall according to any predetermined desired pattern.

The installation and removal of the window buck of the present invention can be best explained by reference to FIG. 4. When framing a wall that is to be poured of concrete, two wall forms are utilized, an outer wall form 50 and an inner wall form 52. These wall forms are typically made of wood with metal corners for reinforcement. The wall forms 50 and 52 are spaced a predetermined distance by using snap ties (not shown).

When it is desired to mount the window buck of the present invention preparatory to pouring a wall, the window buck is mounted to the outer wall form 50 by nailing nails 54 through mounting holes 36 and into the wood portion of the wall form 50. In this fashion, the window buck may be carefully and precisely mounted in the desired position. Because there are several mounting holes 36 located along each flange 22, the window buck may be securely mounted to the outer wall form 50.

The inner wall form 52 may then be placed in position against the inside of the window buck and tied to the outer wall form 50 with snap ties. At this point, the wall form and window buck are ready for concrete 56, or other similar flowable building material, to be poured around the forms to form a wall. As mentioned above, the external surface of the buck 10 is smooth and substantially nonporous. Thus, as the concrete sets, there is very little adherence of the concrete to the window buck. However, to ensure that any adherence is minimized, it is preferable that a releasing agent, such as kerosene or diesel fuel, be coated along those exterior portions of the window buck which will be contacted by the concrete.

After the concrete has been poured and has set, the wall forms 50 and 52 may be removed. The first step in the removal of the buck is that any nails 54 which protrude from outer wall form 50 are clipped off to prevent the worker who is removing the form from being scratched with the nail. The wall forms are removed according to those procedures which are well known in the art. With the wall forms removed, workers may proceed with the removal of the window buck. If any threaded fasteners 40 were used in connection with the window buck, the bolts 46 which held them in place may be removed. The window buck is then free to be extracted out of the window opening.

Because the chemical reaction which occurs as concrete cures is exothermic, the temperature of the concrete will increase as the concrete cures. Temperature increases as the concrete cures range from approximately 10 degrees to approximately 30 degrees, depending upon the ambient temperatures and the amount of calcium which must be added to the concrete mixture. The increase in temperature will cause the window buck to expand according to the coefficient of expansion of the particular material utilized in manufacturing the window buck. Because this expansion of the window buck occurs before the concrete sets, the resulting window opening will be slightly larger than the size of the window buck at ambient temperature.

After the concrete has set, the temperature of the concrete will slowly drop to match that of the ambient conditions. As the temperature of the concrete wall drops to the ambient temperature, the concrete wall will contract. A corresponding temperature decrease and contraction will also occur within the window buck. However, because the coefficient of expansion of plastic is significantly greater than that of concrete, the window buck will contract a greater amount than the concrete leaving a gap between the concrete and the buck.

It should be noted that the coefficient of expansion of plastics is typically greater than that of wood or metal. Thus, the plastic window buck of the present invention will provide a greater degree of contraction than window bucks made of metal or wood. Thus, in addition to the advantage of its light weight, the plastic window buck of the present invention is also easier to remove. By taking advantage of the differential in thermal contraction between the concrete and the window buck, any compression of the window buck by the concrete will be reduced, thereby facilitating the removal of the buck.

After the concrete and window buck reach ambient temperature, the window buck may be removed by pounding on the knock blocks 32 and 34. By taking care to utilize all of the knock blocks, the dynamic forces applied to the knock blocks will slowly and evenly cause the window buck to be removed from the window opening which has been formed in the concrete wall.

As can be viewed in FIG. 3, the sides of the window buck are tapered at a slight angle with respect to a line perpendicular to the plane of the wall. Thus, when the window buck is removed from the wall, it must be extracted in the direction of Arrow B. The taper which is provided to the sides of the window buck is advantageous in that once the initial seal between the window buck and the wall is broken and the buck is "released" from the concrete wall, the entire exterior side of the window buck is retracted a slight distance from the concrete wall.

As the distance the window buck is extracted from the window opening in the direction of Arrow B is increased, the distance between the sides of the window buck and the sides of the concrete window opening also increases. It has been found that when the window buck has been extracted from the window opening approximately one inch in the direction of Arrow B, it is no longer necessary to pound on the knock blocks to further extract the buck, as the worker can simply grasp the handles 30 and manually remove the buck at that point.

A window or other type of insert can then be installed in the resulting opening by utilizing the threaded fasteners which have been provided within the concrete wall. It will be appreciated, of course, that other methods of mounting within the opening may also be employed.

It will be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A polygonal window buck for use in forming a window opening in a wall to be poured of a flowable building material, comprising:

a plurality of plastic side sections attached to form a polygonal perimeter having exterior dimensions substantially the size of the window opening to be formed and having a width approximately equal to the width of the wall of building material, each plastic side section including a first tier, a second tier, and a lip connecting the first tier to the second the plastic side sections being tapered to facilitate removal of the window buck from the wall, the plastic side sections also including flanges attached to at least two side sections;

at least one hole in each flange for use in securing a fastening mechanism within the wall of flowable building material;

at least one plastic side section of the window buck having a knock block to facilitate removal of the window buck from the all;

a plurality of bracing members diagonally oriented with respect to the plastic side sections, each bracing member disposed within the window buck such that each side section is braced to prevent the exterior dimension of the window buck from significantly distorting when the flowable building material is poured around the window buck; and a plurality of supporting handles positioned between the bracing members, said supporting handles being disposed in the vertical plane of the window buck said supporting handles having two ends, each of said first ends of said supporting handles being attached to a first bracing member, each of said second ends of said supporting handles being attached to a second bracing member.

2. A polygonal window buck for use in forming a window opening in a wall to be poured of a flowable building material as defined in claim 1, wherein each bracing member extends substantially the entire width of the side sections of the window buck.

3. A polygonal window buck for use in forming a window opening in a wall to be poured of a flowable building material as defined in claim 1, wherein the plastic side sections are comprises of a material selected from the group consisting of thermoplastic and thermosetting polymers.

4. A polygonal window buck for use in forming a window opening in a wall to be poured of a flowable building material as defined in claim 1, wherein the buck is comprised of four sides and is substantially rectangular in shape.

5. A polygonal window buck for use in forming a window opening in a wall to be poured of a flowable building material as defined in claim 4, wherein the plurality of bracing members comprises four bracing members diagonally oriented within and between adjacent side sections of the window buck.

6. A polygonal window buck for use in forming a window opening in a wall to be poured of a flowable building material as defined in claim 5, wherein there are two supporting handles vertically positioned between adjacent bracing members, each supporting handle having a first end and a second end, said first end being attached to a first bracing member, and said second end being attached to a second bracing member, said second bracing member being adjacent to said first bracing member.

7. A polygonal window buck for use in forming a window opening in a wall to be poured of a flowable building material as defined in claim 1, further comprising a plurality of mounting holes located in the flanges of the plastic side sections for use in mounting the window buck in position while the wall is poured of the flowable building material.

8. A polygonal window buck for use in forming a window opening in a wall to be poured of a flowable building material as defined in cl aim 1, wherein each side section has a middle, and each bracing member is attached at a first end at substantially the middle of a side section and attached at a second end at substantially the middle of the adjacent side section.

9. A polygonal window buck for use in forming a window opening in a wall to be poured of a flowable building material as defined in claim 6, wherein each side section has a middle, and each bracing member is attached at a first end at substantially the middle of a side section and attached at a second end at substantially the middle of the adjacent side section.

10. A polygonal window buck for use in forming a window opening in a wall to be poured of a flowable building material as defined in claim 9, wherein said plastic side sections are comprised of a material selected from the group consisting of thermoplastic and thermosetting polymers.

11. A polygonal window buck for use in forming a window opening in a wall to be poured of a flowable building material as defined in claim 10, wherein said flowable building material is concrete.

* * * * *